US010273634B2

(12) United States Patent
Hietaniemi et al.

(10) Patent No.: US 10,273,634 B2
(45) Date of Patent: Apr. 30, 2019

(54) STRENGTH AGENT, ITS USE AND METHOD FOR INCREASING STRENGTH PROPERTIES OF PAPER

(71) Applicant: Kemira Oyj, Helsinki (FI)

(72) Inventors: Matti Hietaniemi, Espoo (FI); Marcus Lillandt, Ingå (FI); Kari Vanhatalo, Espoo (FI); Asko Koskimäki, Helsinki (FI)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 15/505,086

(22) PCT Filed: Aug. 18, 2015

(86) PCT No.: PCT/FI2015/050533
§ 371 (c)(1),
(2) Date: Feb. 18, 2017

(87) PCT Pub. No.: WO2016/027006
PCT Pub. Date: Feb. 25, 2016

(65) Prior Publication Data

US 2017/0268176 A1 Sep. 21, 2017

(30) Foreign Application Priority Data

Aug. 18, 2014 (FI) ..... 20145728

(51) Int. Cl.

| | |
|---|---|
| ***D21H 11/08*** | (2006.01) |
| ***D21H 11/18*** | (2006.01) |
| ***D21H 11/20*** | (2006.01) |
| ***D21H 17/29*** | (2006.01) |
| ***D21H 17/37*** | (2006.01) |
| ***D21H 17/49*** | (2006.01) |
| ***D21H 17/67*** | (2006.01) |
| ***D21H 21/18*** | (2006.01) |
| ***D21H 23/04*** | (2006.01) |

(52) U.S. Cl.
CPC ..... *D21H 21/18* (2013.01); *D21H 11/08* (2013.01); *D21H 11/18* (2013.01); *D21H 11/20* (2013.01); *D21H 17/29* (2013.01); *D21H 17/37* (2013.01); *D21H 17/375* (2013.01); *D21H 17/49* (2013.01); *D21H 17/67* (2013.01); *D21H 23/04* (2013.01)

(58) Field of Classification Search
CPC ..... D21H 21/18; D21H 17/29; D21H 11/20; D21H 17/375; D21H 17/49; D21H 11/18; D21H 17/37; D21H 11/08; D21H 17/67; D21H 23/04; D21H 23/10; D21H 17/44; D21H 23/08
See application file for complete search history.

(56) References Cited

U.S. PATENT DOCUMENTS

| | | | | |
|---|---|---|---|---|
| 6,228,217 | B1 | 5/2001 | Dickerson et al. | |
| 2002/0062938 | A1 | 5/2002 | Westman et al. | |
| 2002/0074100 | A1* | 6/2002 | Yeh | D21F 11/14 162/198 |
| 2006/0213630 | A1* | 9/2006 | Bunker | D21H 23/10 162/183 |
| 2007/0215301 | A1* | 9/2007 | Bunker | D21H 21/18 162/146 |
| 2011/0048660 | A1 | 3/2011 | Esser et al. | |
| 2011/0112224 | A1* | 5/2011 | Borkar | D21H 21/00 524/47 |
| 2013/0180680 | A1 | 7/2013 | Axrup et al. | |
| 2017/0268176 | A1* | 9/2017 | Hietaniemi | D21H 17/375 |

FOREIGN PATENT DOCUMENTS

| | | | | |
|---|---|---|---|---|
| CA | 2957694 | A1 * | 2/2016 | D21H 17/375 |
| CN | 103865075 | A | 6/2014 | |
| EP | 0362770 | A2 | 4/1990 | |
| EP | 1433898 | A1 | 6/2004 | |
| EP | 1835075 | A1 | 9/2007 | |
| EP | 1918455 | A1 | 5/2008 | |
| EP | 1936032 | A1 | 6/2008 | |
| RU | 2040618 | C1 | 7/1995 | |
| WO | 2010092239 | A1 | 8/2010 | |
| WO | 2012039668 | A1 | 3/2012 | |
| WO | 2013072550 | A2 | 5/2013 | |
| WO | 2013140046 | A1 | 9/2013 | |
| WO | WO-2016027006 | A1 * | 2/2016 | D21H 17/375 |

OTHER PUBLICATIONS

Machine Translation of CN-103865075 A. (Year: 2014).*
Chinese Patent Office, Office Action of Chinese patent application 2015800439172, Kemira Oyj, dated Jan. 17, 2018.
Finnish Patent and Registration Office, Search report of FI20145728, dated Feb. 25, 2015.
Finnish Patent and Registration Office, Office Action of FI20145728, dated Nov. 18, 2016, p. 2 Cited documents.
(Continued)

*Primary Examiner* — Jose A Fortuna
(74) *Attorney, Agent, or Firm* — Berggren LLP Law Firm

(57) ABSTRACT

The invention relates to a strength agent for paper, board or the like. The strength agent comprises a first component, which is refined cellulosic fibers having a refining level of >70° SR, and a second component, which is a synthetic cationic polymer having a charge density of 0.1-2.5 meq/g, determined at pH 2.7, and an average molecular weight of >300 000 g/mol. The invention relates also to a use of the strength agent and to a method for increasing strength properties of paper, board or the like.

16 Claims, No Drawings

(56) References Cited

OTHER PUBLICATIONS

Bobu, E et al., Technical University of Iasi, Romania. The effect of formation of paper properties with respect to different aggregation mechanismus, Symposium presentation http://www.pfi.no/Documents/Cost Action E32/MADRIDOctober 6-7_2005/FormationBobu.pdf: [retrieved Nov. 16, 2016]. "Paper/Ink Properties and their Relation to Offset Printability", 2005-10-6-7, Madrid.
Russian Patent Office, Search Report for patent application No. 2017108901, dated Jan. 17, 2019.

* cited by examiner

STRENGTH AGENT, ITS USE AND METHOD FOR INCREASING STRENGTH PROPERTIES OF PAPER

PRIORITY

This application is a U.S national application of PCT-application PCT/FI2015/050533 filed on Aug. 18, 2015 and claiming priority of Finnish national application FI20145728 filed on Aug. 18, 2014, the contents of all of which are incorporated herein by reference.

The present invention relates to a strength agent, its use and method for increasing strength properties of paper, board or the like according to the preambles of the enclosed independent claims.

Synthetic cationic polymers have been used as strength agents in manufacture of paper and board. They are normally added to the fibre stock, where they interact with the fibres and other components of the stock. However, it has been observed that the synthetic polymers have a limited ability to increase the strength properties of the final paper or board in cases where the fibre stock comprises mechanical pulp, recycled pulp and/or has high filler content. Generally the use of inexpensive fibre sources, such as old corrugated containerboard (OCC) or recycled paper, has been increasing in manufacture of paper and board over the past decades. OCC comprises mainly used recycled unbleached or bleached kraft pulp fibres, hardwood semi-chemical pulp fibres and/or grass pulp fibres. Also the use of mineral fillers has been increasing in manufacture of paper and board. Consequently, there is a constant need and search for new ways to increase the strength properties of the paper or board. Especially there is a need for cost effective ways to increase the strength properties of paper and board.

Nanocellulose is produced from various fibre sources comprising cellulosic structures, such as wood pulp, sugar beet, bagasse, hemp, flax, cotton, abaca, jute, kapok and silk floss. Nanocellulose comprises liberated semi-crystalline nanosized cellulose fibrils having high length to width ratio. A typical nanosized cellulose fibril has a width of 5-60 nm and a length in a range from tens of nanometers to several micrometers. Document WO 2013/072550 discloses that nanocellulose may be used in production of release paper to lower the grammage and to improve the initial wet strength of the web. However, the large scale production of nanocellulose is more intricate process, involving extensive chemical and/or mechanical treatment.

An object of this invention is to minimise or even totally eliminate the disadvantages existing in the prior art.

Another object of the present invention is to provide a strength agent, which provides increased strength properties for the final paper or board and which is easy to produce, also in large scale.

A further object of the present invention is to provide a method with which the strength properties of the final paper or board can be increased.

These objects are attained with the invention having the characteristics presented below in the characterising parts of the independent claims.

Some preferred embodiments of the present invention are presented in the dependent claims.

The embodiment examples and advantages mentioned in this text relate, as applicable, to the method, strength agent as well as the use of the strength agent, even if this is not always specifically stated.

Typical strength agent for paper, board or the like according to the present invention comprises a first component, which is refined cellulosic fibres having a refining level of >70° SR, a second component, which is a synthetic cationic polymer having a charge density of 0.1-2.5 meq/g, determined at pH 2.7, and an average molecular weight of >300 000 g/mol.

Typical use of a strength agent according to the present invention is for increasing strength properties of paper, board or the like.

Typical method according to the present invention for increasing strength properties of paper, board or the like, comprises obtaining a fibre stock, adding to the fibre stock a strength agent comprising a first component and a second component according to the present invention.

Now it has been surprisingly found that strength properties of paper, board or the like can be significantly increased with a strength agent comprising mechanically refined cellulosic fibre with a refining level of >70° SR, i.e. a first component, and a synthetic cationic polymer with well-defined charge density and average molecular weight, i.e. a second component. Especially the Scott Bond strength of the obtained paper or board is unexpectedly enhanced by the use of the strength agent according to the present invention. It is assumed, without wishing to be bound by a theory, that highly refined cellulosic fibres are able to effectively increase the relative bonded area between the fibres in paper structure, and simultaneously the cationic strength polymer optimizes the bonding strength between the different components.

In context of the present application the abbreviation "SR" denotes Schopper-Riegler value, which is obtained according to a procedure described in standard ISO 5267-1:1999. Schopper-Riegler value provides a measure of the rate at which a dilute pulp suspension is dewatered. The drainability of the pulp is related to length, surface conditions, and/or swelling of the fibres in the stock. Schopper-Riegler value effectively indicates the amount of mechanical treatment to which the fibres of the pulp have been subjected. The larger SR-value the pulp has, the more refined fibres it contains.

Cellulosic fibres which are suitable for use in the present invention as a first component of the strength agent are hardwood fibres, softwood fibres or non-wood fibres, such as bamboo or kenaf. The fibres can be bleached or non-bleached. Preferably the fibres are softwood fibres, and they may originate from pine, spruce or fir. The cellulosic fibres are obtained by kraft pulping or sulphite pulping, preferably by kraft pulping. After kraft pulping or sulphite pulping the fibres are subjected preferably solely to mechanical refining until the desired SR-value is reached. Thus the production of cellulosic fibres suitable for use in the present invention is relatively easy and simple, and does not require any additional equipment or chemicals.

According to one preferred embodiment of the invention the cellulosic fibres, which are subjected to the mechanical refining, are bleached softwood fibres obtained by kraft pulping. The cellulosic fibres may have average length-weighted projected fibre length>1.5 mm, preferably >1.8 mm, analysed by using kajaaniFiberLab™ analyser (Metso, Inc., Finland).

According one embodiment of the invention the cellulosic fibres used as a first component have a refining level of 70-98° SR, preferably 75-90° SR, more preferably 77-87° SR. It has been observed that with these refining levels it is possible to obtain the strength effect which is achieved while still keeping the used refining energy and the drainage performance on an acceptable level. The refined cellulosic fibres may have average length-weighted projected fibre length in the range of 0.3-2.5 mm, preferably 0.4-2 mm, sometimes 0.3-0.8 mm or 0.4-0.7 mm, and/or they may have a fibre width in the range of 5-60 μm, preferably 10-40 μm. the fibre length and the fibre width of the refined fibres is measured by using a kajaaniFiberLab™ analyser (Metso, Inc., Finland).

According to one embodiment of the invention the second component of the strength agent is a synthetic cationic polymer, which is selected from copolymers of methacrylamide or acrylamide and at least one cationic monomer. The synthetic cationic polymer may be linear or cross-linked, preferably linear. The cationic monomer may be selected from a group consisting of methacryloyloxyethyl-trimethyl ammonium chloride, acryloyloxyethyltrimethyl ammonium chloride, 3-(methacrylamido) propyltrimethyl ammonium chloride, 3-(acryloylamido) propyltrimethyl ammonium chloride, diallyldimethyl ammonium chloride, dimethylaminoethyl acrylate, dimethylaminoethyl methacrylate, dimethylamino-propylacrylamide, dimethylaminopropylmethacrylamide, or a similar monomer. According to one preferred embodiment of the invention the synthetic cationic polymer is a copolymer of acrylamide or methacrylamide with (meth)acryloyloxyethyltrimethyl ammonium chloride.

The strength agent is preferably synthetic polymer which is prepared by solution or dispersion polymerisation.

The charge density of the synthetic cationic polymer, which is used a second component, is preferably optimised so that it is possible to obtain a maximal strength effect without overcationising the Zeta-potential of the cellulosic fibres. The synthetic cationic polymer may have a charge density of 0.2-2.5 meq/g, preferably 0.3-1.9 meq/g, more preferably 0.4-1.35 meq/g, even more preferably 1.05-1.35 meq/g, at pH 2.7. Charge densities are measured by using Mütek PCD 03 tester.

According to one embodiment of the invention the synthetic cationic polymer, i.e. the second component, has an average molecular weight of 300 000-6 000 000 g/mol, preferably 400 000-4 000 000 g/mol, more preferably 450 000-2 900 000 g/mol, even more preferably 500 000-1 900 000 g/mol, even more preferably 500 000-1 450 000 g/mol. Molecular weight is measured by using known chromatographic methods, such as gel permeation chromatography employing size exclusion chromatographic columns with polyethylene oxide (PEO) calibration. If the molecular weight of the polymer, measured by gel permeation chromatography exceeds 1 000 000 g/mol, the reported molecular weight is determined by measuring intrinsic viscosity by using Ubbelohde capillary viscometer.

According to one embodiment of the invention the strength agent comprises 70-99.8 weight-%, preferably 90-99 weight-% of refined cellulosic fibres, i.e. the first component, and 0.5-10 weight %, preferably 1-5 weight-%, of synthetic cationic polymer, i.e. the second component. The weight percentages are calculated from dry content of the strength agent.

The strength agent may comprise refined cellulosic fibres and synthetic cationic polymer in ratio of 100:1-5:1, preferably 70:1-20:1.

According to one preferable embodiment, the refined cellulosic fibres and synthetic cationic polymer, i.e. the first and second component, are mixed together to form a strength agent composition before the strength agent is added to the fibre stock. Alternatively, the refined cellulosic fibres and synthetic cationic polymer can be added to the fibre stock separately but simultaneously.

According to another embodiment of the invention the first component of the strength agent is first added to the stock, and thereafter the second component of the strength agent is added to the stock.

According to yet another embodiment of the invention the second component of the strength agent is first added to the stock, and thereafter the first component of the strength agent is added to the stock.

According to one embodiment of the invention the strength agent may in addition to the first and second component also comprise cationic or amphoteric starch. Cationic or amphoteric starch has usually a degree of substitution (DS), which indicates the number of cationic groups in the starch on average per glucose unit, in the range of 0.01-0.5, preferably 0.04-0.3, more preferably 0.05-0.2.

Cationic starch may be any suitable cationic starch used in paper making, such as potato, rice, corn, waxy corn, wheat, barley or tapioca starch, preferably corn starch or potato starch. Typically the amylopectin content of the starch is in the range of 65-90%, preferably 70-85%. Starch may be cationised by any suitable method. Preferably starch is cationised by using 2,3-epoxypropyltrimethylammonium chloride or 3-chloro-2-hydroxypropyl-trimethylammonium chloride, 2,3-epoxypropyltrimethylammonium chloride being preferred. It is also possible to cationise starch by using cationic acrylamide derivatives, such as (3-acrylamidopropyl)-trimethylammonium chloride.

According to one embodiment at least 70 weight-% of the starch units of the cationic starch have an average molecular weight (MW) over 20 000 000 g/mol, preferably 50 000 000 g/mol, more preferably 100 000 000 g/mol.

According to one preferred embodiment of the invention the cationic starch component is non-degraded, which means that the starch component has been modified solely by cationisation, and its backbone is non-degraded and non-cross-linked. Cationic non-degraded starch component is of natural origin.

The strength agent may also or alternatively comprise amphoteric starch Amphoteric starch comprises both anionic and cationic groups, and its net charge may be neutral, cationic or anionic, preferably cationic.

The strength agent may further comprise surfactants, salts, filler agents, other polymers and/or other suitable additional constituents. The additional constituents may improve the performance of the strength agent, its compatibility with other papermaking ingredients or its storage stability.

The strength agent may be added to the pulp in such amount that the dose of the first component, i.e. refined cellulosic fibres, is in the range of 0.1-10 weight-%, preferably 0.5-8 weight-%, more preferably 1.5-6 weight-%, and the dose of the second component, i.e. the synthetic cationic polymer, is in the range of 0.02-0.5 weight-%, preferably 0.07-0.4 weight-%, more preferably 0.12-0.25 weight-%, calculated per dry fibre stock.

The strength agent, any or all of its components is added to fibre stock before the headbox of a paper machine or at the latest to the headbox of a paper machine. Preferably the strength agent, any or all of its components is added to thick fibre stock, which has a consistency of at least 20 g/l, preferably more than 25 g/l, more preferably more than 30 g/l. In the present context the term "fibre stock" is understood as an aqueous suspension, which comprises fibres and optionally inorganic mineral filler. The final paper or board product, which is made from the fibre stock may comprise at least 5%, preferably 10-40%, more preferably 11-19% of mineral filler, calculated as ash content of the uncoated paper or board product. Mineral filler may be any filler conventionally used in paper and board making, such as ground calcium carbonate, precipitated calcium carbonate, clay, talc, gypsum, titanium dioxide, synthetic silicate, aluminium trihydrate, barium sulphate, magnesium oxide or their any of mixtures.

At least part of the fibres in the fibre stock preferably originate from mechanical pulping, preferably from chemi-thermo mechanical pulping. According to one preferred embodiment the fibre stock to be treated may comprise even more than 60 weight-% of fibres originating from mechanical pulping. In some embodiments the fibre stock may comprise >10 weight-% of fibres originating from chemical pulping. According to one embodiment the fibre stock may comprise <50 weight-% of fibres originating from chemical pulping.

The present invention is suitable for improving strength of paper grades including super calendered (SC) paper, ultra-light weight coated (ULWC) paper, lightweight coated (LWC) paper and newsprint paper, but not limited to these. The weight of the final paper web may be 30-800 g/m$^2$, typically 30-600 g/m$^2$, more typically 50-500 g/m$^2$, preferably 60-300 g/m$^2$, more preferably 60-120 g/m$^2$, even more preferably 70-100 g/m$^2$.

The present invention is also suitable for improving strength of board like liner board, fluting, folding boxboard (FBB), white lined chipboard (WLC), solid bleached sulphate (SBS) board, solid unbleached sulphate (SUS) board or liquid packaging board (LPB), but not limited to these. Boards may have grammage from 70 to 500 g/m$^2$.

EXPERIMENTAL

General principle of manufacturing hand sheets with Rapid Köthen hand sheet former is as follows:

Sheets are formed with Rapid Köthen sheet former, ISO 5269/2. Fibre suspension is diluted to 0.5% consistency with tap water, which conductivity has been adjusted with NaCl to 550 μS/cm in order to correspond the conductivity of real process water. The fibre suspension is stirred at a constant stirring rate at 1000 rpm in a jar with a propeller mixer. Strength agent according to the present invention for improving the strength properties of the final sheet is added into the suspension under stirring 60 s before drainage. All sheets are dried in vacuum dryer for 5 min at 1000 mbar pressure and at 92° C. temperature. After drying the sheets are pre-conditioned for 24 h at 23° C. in 50% relative humidity before testing the tensile strength of the sheets.

For Zeta potential measurement fibre suspension is diluted to 0.5% consistency with tap water, which conductivity has been adjusted with NaCl to 550 μS/cm in order to correspond the conductivity of real process water.

Measurement methods and devices used for characterisation of hand sheet samples are disclosed in Table 1.

TABLE 1

Measured hand sheet properties and standard methods and device used for measurements.

| Measurement | Standard, Device |
|---|---|
| Grammage | ISO 536, Mettler Toledo |
| Tensile strength | ISO 1924-3, Lorentzen & Wettre Tensile tester |

TABLE 1-continued

Measured hand sheet properties and standard methods and device used for measurements.

| Measurement | Standard, Device |
|---|---|
| Scott bond | T 569, Huygen Internal Bond tester |
| Zeta potential | Mütek SZP-06 |

Example 1

Hand sheets were formed as described above. Sheet basis weight was 80 g/m$^2$.

The fibre suspension comprised 50 weight-% of long fibre fraction, which was pine kraft pulp, SR 18, and 50 weight-% short fibre fraction, which was eucalyptus pulp, SR18.

The strength agent comprised:

1) a first component, which was pine kraft pulp with refining level of SR 90. The refining of the pine kraft pulp was performed with Valley-beater, 1.64 weight-%, calculated as dry fibre, and 2) a second component which was cationic polyacrylamide, average molecular weight 800 000 g/mol, charge density 1.3 meg/g.

The results of Example 1 are given in Table 2. All the dosages are given as kg/pulp ton and as active component.

TABLE 2

Results of Example 1

| Test Point | 1$^{st}$ component dose | 2$^{nd}$ component dose | Tensile index [Nm/g] | Scott Bond, [J/m2] | Zeta potential, [mV] |
|---|---|---|---|---|---|
| 1 | — | — | 38.1 | 150 | −91 |
| 2 | 50 | — | 42.1 | 171 | −87 |
| 3 | — | 2 | 44.1 | 228 | −30 |
| 4 | 50 | 1 | 44.3 | 228 | −58 |
| 5 | 50 | 2 | 49.2 | 260 | −33 |
| 6 | 50 | 4 | 48.1 | 258 | 6 |

From Table 2 it can be seen that the strength agent according to the invention comprising both refined cellulosic fibres and synthetic cationic polymer improves the tensile index and Scott Bond values of the obtained paper. It is also seen that when strength agent is used, lower amounts of synthetic cationic polymer yield similar results than higher amount of synthetic cationic polymer alone. This may indicate that by using the present invention, lower amount of synthetic cationic polymers can be used, which have positive effect on overall process economy, as usually the synthetic polymers are the expensive components in manufacture of paper or board.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A strength agent for paper, or board, which agent is formed by mixing a first component with a second component before the strength agent is added to a fibre stock, or which agent is a combination formed by separate but simultaneous addition of the first component and the second component to the fibre stock, wherein the strength agent comprises:

the first component, which is mechanically refined cellulosic fibres having a refining level in the range of 70-98° SR, the second component, which is a synthetic cationic polymer, which is a copolymer of methacrylamide or acrylamide and at least one cationic monomer, and has a charge density of 0.1-2.5, determined at pH 2.7, and an average molecular weight of >300000 g/mol, wherein the strength agent comprises refined cellulosic fibres and synthetic cationic polymer in a weight ratio range of approximately 12.5:1 to 50:1.

2. The strength agent according to claim 1, wherein the cellulosic fibres have a refining level of 75-90° SR.

3. The strength agent according to claim 1 wherein the first component consists of cellulosic fibres, which are obtained by kraft pulping and which have been subjected to mechanical refining.

4. The strength agent according to claim 1, wherein the cellulosic fibres are bleached softwood fibres obtained by kraft pulping.

5. The strength agent according to claim 1, wherein the synthetic cationic polymer has a charge density of 0.2-2.5 meq/g.

6. The strength agent according to claim 1, wherein the synthetic cationic polymer has an average molecular weight of 300000-6000000 g/mol.

7. The strength agent according to claim 1, wherein the cationic monomer is selected from a group consisting of methacryloyloxyethyltrimethyl ammonium chloride, acryloyloxyethyltrimethyl ammonium chloride, 3-(methacrylamido) propyltrimethyl ammonium chloride, 3-(acryloylamido) propyltrimethyl ammonium chloride, diallyldimethyl ammonium chloride, dimethylaminoethyl acrylate, dimethylaminoethyl methacrylate, dimethylaminopropylacrylamide and dimethylaminopropylmethacrylamide.

8. The strength agent according to claim 1, wherein it comprises cationic or amphoteric starch with a substitution degree in the range of 0.01-0.5.

9. The strength agent according to claim 1, wherein it comprises 70-98 weight-%, of refined cellulosic fibres and 1.4-7.8 weight % of synthetic cationic polymer.

10. A method for increasing strength properties of paper or board, comprising;

obtaining a fibre stock, adding to the fibre stock a strength agent comprising a first component and a second component according to claim 1.

11. The method according to claim 10, wherein the fibre stock comprises mineral filler.

12. The method according to claim 10, wherein the first component of the strength agent is added to the stock, and thereafter the second component of the strength agent.

13. The method according to claim 10 wherein the second component of the strength agent is added to the stock, and thereafter the first component of the strength agent.

14. The method according to claim 10, wherein the strength agent or any of its component is added to the thick fibre stock, which has a consistency of at least 20 g/l.

15. The method according to claim 14, wherein the consistency is at least 25 g/l.

16. The method of claim 14, wherein the consistency is at least 30 g/l.

* * * * *